US005755002A

United States Patent [19]

Lacy

[11] Patent Number: 5,755,002

[45] Date of Patent: May 26, 1998

[54] SEWER CLEANING TOOL

[76] Inventor: Walter J. Lacy, 712 Briargrove, Alvin, Tex. 77511

[21] Appl. No.: 762,311

[22] Filed: Dec. 9, 1996

[51] Int. Cl.[6] ..... B08B 9/02

[52] U.S. Cl. ..... 15/104.31; 15/104.05; 15/104.095

[58] Field of Search ..... 15/104.069, 104.05, 15/104.09, 104.095, 104.096, 104.11, 104.31

[56] References Cited

U.S. PATENT DOCUMENTS

| | | | |
|---|---|---|---|
| 1,077,784 | 11/1913 | Asbury | 15/104.31 |
| 1,221,734 | 4/1917 | Hochberg | 15/104.09 |
| 1,355,726 | 10/1920 | Zlatnik | 15/104.095 |
| 1,402,786 | 1/1922 | Muehl | 15/104.095 |
| 2,046,915 | 7/1936 | Kersey | 15/104.09 |
| 2,157,493 | 5/1939 | Miller | 15/104.069 |
| 2,275,939 | 3/1942 | Baker | 15/104.095 |
| 2,402,223 | 6/1946 | Wright | 15/104.095 |
| 2,948,909 | 8/1960 | Haeckler | 15/104.095 |
| 3,106,006 | 10/1963 | Perovich | 15/104.095 |
| 3,112,227 | 11/1963 | Curtis | 15/104.095 |
| 4,001,911 | 1/1977 | Watson | 15/104.09 |
| 4,292,704 | 10/1981 | Joanis, Sr. | 15/104.095 |
| 5,418,997 | 5/1995 | DeFrange | 15/104.095 |

FOREIGN PATENT DOCUMENTS

| | | | |
|---|---|---|---|
| 0377653 | 9/1907 | France | 15/104.31 |
| 2806725 | 8/1979 | Germany | 15/104.095 |
| 0658607 | 11/1986 | Switzerland | 15/104.05 |

*Primary Examiner*—Randall Chin
*Attorney, Agent, or Firm*—Bill B. Berryhill

[57] ABSTRACT

A sewer cleaning tool for attachment to one end of a cable, the other end of which is connected to a rotary power drive. The tool has an elongated body having a forward end and a rearward end, the rearward end being removably attachable to one end of the cable. A plurality of vane members project radially from the body at uniformly spaced intervals thereround providing longitudinal outer edges and transverse forward and rearward edges. The vane members act cooperatively as a pump impeller, upon rotation of the tool, for agitation of sewer line fluids to dislodge any materials lodged therein.

7 Claims, 1 Drawing Sheet

SEWER CLEANING TOOL

BACKGROUND OF THE INVENTION

1. Field of the Invention

The present invention pertains to sewer cleaning tools. More specifically, the present invention pertains to sewer cleaning tools of the type which are attached to the end of a cable, the other end of which is connected to a rotary power drive and which is utilized primarily to clean or unblock sewer lines.

2. Description of the Prior Art

In most plumbing systems, waste water, body waste and other solid materials are discharged into drain lines which are connected to a sewer line which is in turn connected to a sewer trunk of greater diameter. The sewer lines, typically several inches in diameter, provide a conduit for all sewer discharge from a home or apartment to the main sewer trunk. Occasionally such sewer lines become obstructed by roots, infiltrating soil materials and/or other solids discharged into the line, e.g. toilet tissue, paper towels, diapers, etc.

When a sewer line becomes clogged with such materials, it is necessary that the clogged materials be removed. In recent years, various cleaning tools have been developed which are attached to one end of a cable or a wire which is typically wound on a reel and the opposite end of which is connected to a rotary power drive. The power drive rotates the cable or "snake" which in turn rotates the tool at the end thereof. The tool is typically provided with some sort of cutter or cutting blades primarily designed to cut away roots or to cut through materials lodged in the sewer line. Examples of such tools may be seen in U.S. Pat.

Nos 2,786,218; 4,104,757; 4,184,220 and 5,418,997. Most such tools of the prior art are primarily for cutting. These may be effective for roots or materials which project inwardly through the joints of sewer line. However, they may not be effective in removing other type of blockages. Sewer lines flow by gravity with little elevation drop. This frequently causes waste to build up and cling to walls of the sewer line for substantial lengths of the pipe. With a lengthy blockage of toilet tissue or other types of paper, a cutting tool may not be effective in dislodging the blockage therefrom, due to length and resistance. Thus, there appears to be a need for a different type of sewer cleaning tool, i.e. one which, rather than being designed to cut away roots and the like, is designed to dislodge accumulated tissue paper or other types of materials.

SUMMARY OF THE PRESENT INVENTION

The present invention provides a sewer cleaning tool for attachment to one end of a cable the other end of which is connected to a rotary power drive. The tool comprises an elongated body having forward and rearward ends, the rearward end being removably attachable to one end of the cable. The tool also comprises a plurality of vane members which project radially from the body at uniformly spaced intervals therearound. These vane members provide longitudinal outer edges and transverse forward and rearward edges, acting cooperatively as a pump impeller, upon rotation of the tool, for agitation of sewer line fluids to dislodge any materials lodged therein.

In preferred embodiments of the invention, the tool body and the vane members are of substantially resilient material. This gives the tool flexibility of movement through non-aligned and curved sewer lines. This also imparts flexibility to the vane members which, acting as a pump impeller, rotate, imparting agitation and pumping motion to the fluids in the sewer line so as to dislodge the accumulated materials directly forward thereof. In alternate embodiments, a cutting device may be attached to the body forward of the vane members to aid in dislodging these materials.

Thus, the tool of the present invention is especially designed for and effective in removal of accumulated tissue paper or other materials which might not otherwise be dislodged utilizing a tool designed primarily for cutting of roots. Many other objects and advantages of the invention will be understood from reading the description which follows in conjunction with the accompanying drawings.

DESCRIPTION OF PREFERRED EMBODIMENTS

Figure 1:
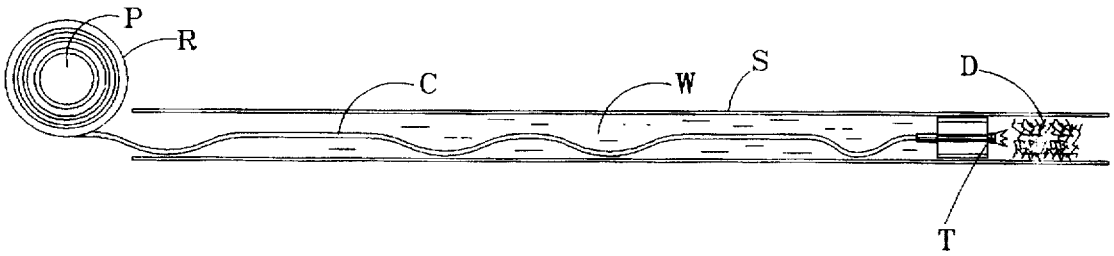
FIG. 1 is a pictorial representation of a sewer line, illustrating a stoppage therein and employment of a sewer cleaning tool, for unblocking the stoppage, according to a preferred embodiment of the invention.

Referring first to FIG. 1, there is shown a sewer line 5 which has been blocked with tissue, body waste or other materials D. There is also shown a sewer cleaning tool T which is attached to one end of a cable C a portion of which is wrapped on a reel R and the opposite end of which is attached to a rotary power drive such as an electric motor. Typically, the sewer line 5 would be holding water W therein, the water being prevented from flowing through the sewer line 5 by the blockage D therein. The blockage D may vary from several inches to many feet.

Figure 2:
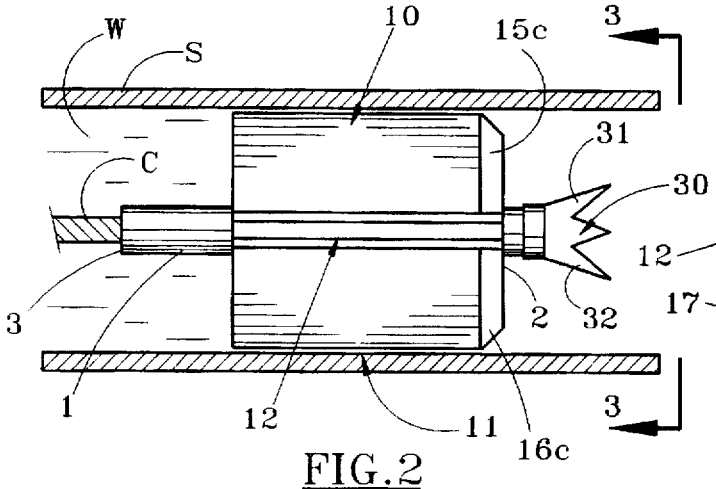
FIG. 2 is a longitudinal view of a sewer cleaning tool, according to a preferred embodiment of the invention, shown in a sewer line for which it would be used, the sewer line being shown in section.
Figure 3:
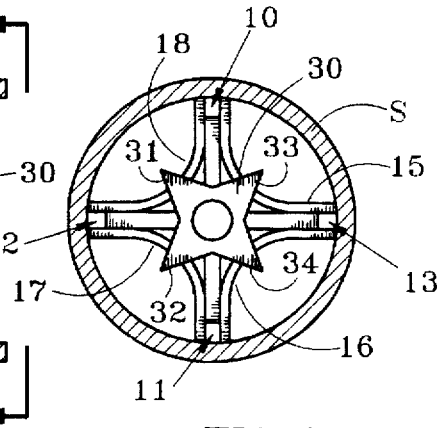
FIG. 3 is a forward end view of the sewer cleaning tool of FIG. 2 shown in the sewer line, sewer line being shown in cross-section.
Figure 4:
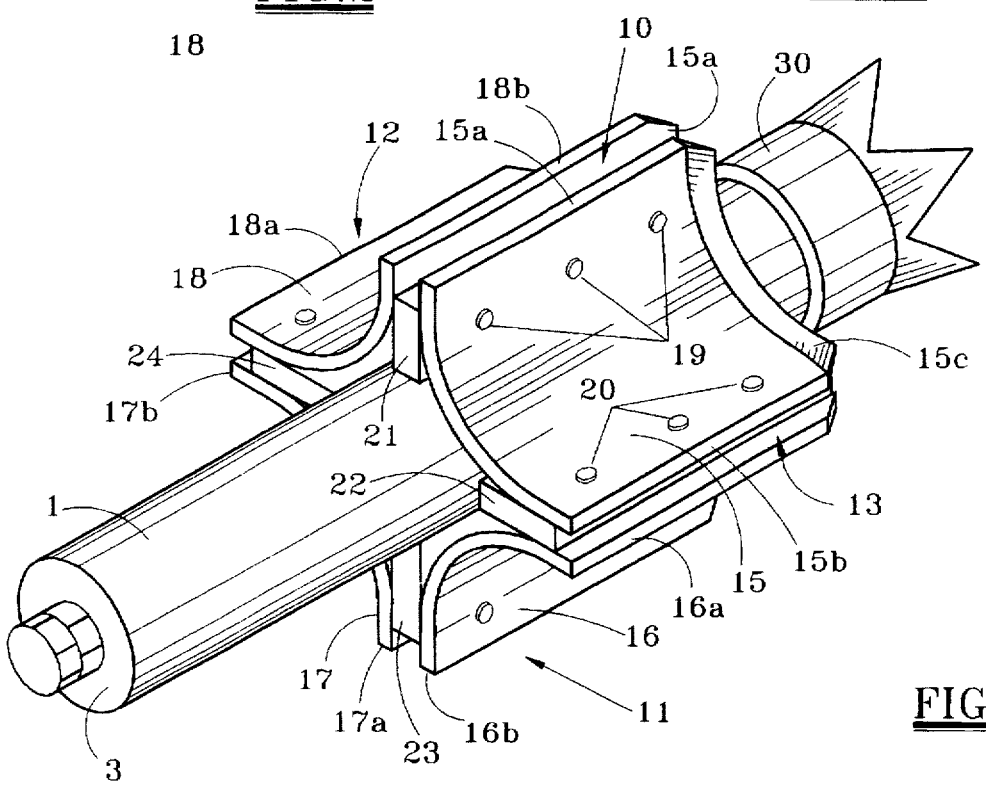
FIG. 4 is a perspective view of the sewer cleaning tool of FIGS. 2 and 3, according to a preferred embodiment thereof.

Referring now to FIGS. 2, 3 and 4, the sewer cleaning tool T will be described in greater detail. The tool T comprises an elongated body 1 having a forward end 2 and a rearward end 3. The rearward end 3 is provided with any suitable attachment for removably attaching tool T to one end of the cable C. The body 1 is preferably of a semi-rigid material but has some flexibility so as to allow the tool flexibility of movement of non-aligned and curved sewer lines.

A plurality of vane members 10, 11, 12, 13 project radially from the body 1 providing transverse forward and rearward edges and mutually parallel outer edges. In the exemplary embodiment, the vane members 10, 11, 12 and 13 are formed by a plurality of 15, 16, 17 and 18, of substantially rectangular members of resilient material bent into U-shaped cross-section so that the opposite edges 15*a*, 15*b*, 16*a*, 16*b*, 17*a*, 17*b*, 18*a*, 18*b* thereof project radially cooperating with corresponding opposite edges of an adjacent rectangular member to form the mutually parallel longitudinal outer edges of the vane members 10, 11, 12 and 13. For example, rectangular edges 15*a* and 18*b* cooperate to form the outer edge of vane 10, edges 15*b* and 16*a* cooperate to form the outer edges of vane 13, 16*b* and 17*a* cooperate to form the outer edges of vane 11, 17*b* and 18*a* cooperate to form the outer edges of vane 12.

After the rectangular members 15, 16, 17 and 18 are bent into their U-shaped cross-sections they are attached to the body 1 along a central longitudinal axis. In addition, adjacent portions of a pair of rectangular members may be fixed to each other by connection means. See for example connectors 19 and 20. In some cases these connection means may also include spacers 21, 22, 23, 24 between adjacent portions of pairs of the rectangular members 15, 16, 17 and 18 so that the outer edges of each of the vane members 10, 11, 12 and 13 is formed of parallel, slightly separated and corresponding edges 15*a* and 18*b*, 15*b* and 16*a*, 16*b* and 17*a*, 17*b* and 18*a* of the rectangular members 15, 16, 17 and 18.

In some cases the forward edges of the vane members 10, 11, 12, 13 or the rectangular members by which they are formed may be thinner than the remainder of the vane to form edges which may act as cutters in dislodging some of the materials. Such edges are illustrated at 15*c* and 16*c* in FIG. 2. In addition, a cutting device 30 with cutting blades 31, 32, 33, 34 thereon may be fixed to the forward end of the body 1 forward of the vane members 10, 11, 12 and 13 to aid in dislodging lodged or accumulated materials.

In operation, the tool T is attached to the end of the cable C, and rotated and pushed through the sewer line S until it contacts the blocking or lodged material D therein. Then the tool T is rotated, preferably at high speed, by the rotary power drive P causing the vane members 10, 11, 12 and 13 to act cooperatively as a pump impeller, pumping and agitating the water W near to the lodged material D. The pumping and agitation of the water also agitates the tissue or other similar materials D dislodging the materials, creating a slurry and eventually allowing the slurry to move through the sewer line S, unstopping the sewer line S and allowing the water W and other waste to flow therethrough. The tool T is not primarily designed for cutting. However, if equipped with a cutter such as the cutter 30, the cutter 30 may shred the tissue or other materials and aid in agitation and dislodging of the materials therefrom.

Thus, the sewer cleaning tool of the present invention, unlike most of those of the prior art, is not designed primarily for cutting of roots or other materials. Instead, it is designed to act more as the impeller of a pump so as to impart agitation and pumping motion to fluids in the sewer line just upstream of tissue, paper and other materials which have stopped flow through the sewer line. This unique design is very effective in agitating and dislodging such materials therefrom.

A preferred embodiment and several alternates thereof have been described herein. Many other variations of the invention may be made by those skilled in the art without departing from the spirit of the invention. Accordingly, it is intended that the scope of the invention be limited only by the claims which follow.

I claim:

1. A sewer cleaning tool for attachment to one end of a cable, the other end connected to a rotary power drive, said tool comprising:

an elongated body having a forward end and a rearward end, said rearward end being removably attachable to said one end of said cable; and a plurality of vane members of substantially resilient material projecting radially from said body at uniformly spaced intervals therearound providing transverse forward and rearward edges and mutually parallel longitudinal outer edges, each of said vane members being formed by a plurality of rectangular members attached to said body along a central longitudinal axis, said rectangular members being bent into a U-shaped cross-section so that opposite edges thereof cooperate with corresponding opposite edges of an adjacent rectangular member to form said mutually parallel longitudinal outer edges of said vane members, said vane members acting cooperatively as a pump impeller, upon rotation of said tool, for agitation of sewer line fluids to dislodge any materials lodged therein.

2. A sewer cleaning tool as set forth in claim 1 in which each of said vane members is at least partially formed by correspondingly connected portions of a pair of said rectangular members.

3. A sewer cleaning tool as set forth in claim 2 including connection means by which said correspondingly connected portions of a pair of said rectangular members are fixed to each other.

4. A sewer cleaning tool as set forth in claim 3 in which said connection means includes a spacer between said correspondingly connected portions of a pair of said rectangular members so that said outer edges of each of said vane members is formed of parallel slightly separated corresponding opposite edges of said pair of said rectangular members.

5. A sewer cleaning tool as set forth in claim 1 in which said forward edges of said vane members are thinner than the remainder of said vane members forming cutting edges to aid in dislodging said lodged materials.

6. A sewer cleaning tool as set forth in claim 1, said cutting blades projecting radially from said body substantially less than said vane members.

7. A sewer cleaning tool as set forth in claim 1 in which said body is solid but of a substantially semi-rigid material allowing said tool flexibility of movement through non-aligned and curved sewer lines.

* * * * *